US007625255B2

(12) United States Patent
Ide et al.

(10) Patent No.: US 7,625,255 B2
(45) Date of Patent: Dec. 1, 2009

(54) MARINE PROPULSION MACHINE PROVIDED WITH DRIVE SHAFT

(75) Inventors: Shinichi Ide, Saitama (JP); Mitsuaki Kubota, Saitama (JP); Masahiro Akiyama, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 11/822,021

(22) Filed: Jun. 29, 2007

(65) Prior Publication Data

US 2008/0014806 A1 Jan. 17, 2008

(30) Foreign Application Priority Data

Jun. 30, 2006 (JP) ..... 2006-182272

(51) Int. Cl.
*B63H 23/34* (2006.01)

(52) U.S. Cl. ..... 440/88 M; 440/83; 440/75

(58) Field of Classification Search ..... 440/75, 440/83, 88 M, 76
See application file for complete search history.

(56) References Cited

U.S. PATENT DOCUMENTS 1,903,350 A * 4/1933 Landrum ..... 440/75
3,487,803 A * 1/1970 Alexander, Jr. ..... 440/75
5,908,338 A * 6/1999 Kawasaki et al. ..... 440/89 R

FOREIGN PATENT DOCUMENTS

| | | | |
|---|---|---|---|
| JP | 63-97489 | A | 4/1988 |
| JP | 3-21589 | A | 1/1991 |
| JP | 5-52107 | A | 3/1993 |
| JP | 5-270490 | A | 10/1993 |

* cited by examiner

*Primary Examiner*—Ed Swinehart
(74) *Attorney, Agent, or Firm*—Westerman, Hattori, Daniels & Adrian, LLP

(57) ABSTRACT

An outboard motor S has a first drive shaft 31 directly interlocked with an engine E, a second drive shaft 32, an intermediate gear mechanism 33 interlocking the first drive shaft 31 and the second drive shaft 32, an output gear mechanism 50 driven by power transmitted thereto through the second drive shaft 32, a propeller shaft 17 driven for rotation by power transmitted thereto through the output gear mechanism 50, and a gear case 13 holding the output gear mechanism 50. The second drive shaft 32 extends downward beyond a vertical position corresponding to the lower end of the first drive shaft 31. The gear case 13 is provided with water intakes 98 through which a water pump 90 sucks water in a space between the first drive shaft 31 and the output gear mechanism 50 with respect to a vertical direction on the front side of the second drive shaft 32. The space for the water intakes 98 can be easily secured because the second drive shaft 32 is disposed on the rear side of the first drive shaft 31.

7 Claims, 7 Drawing Sheets

LEFT
RIGHT
FRONT
REAR
21c
62a
63
61b(61)
d2
L4
63a
63b
e2
62d
62e
25
30
f2
f3
f4
e
L3
62
21a
62b
55a
31
a
a
L1
e3
21(13)
48
f1
49
53(50)
16
55b
54
17a(17)
55
32
56
e1
d1
58
57
L2

MARINE PROPULSION MACHINE PROVIDED WITH DRIVE SHAFT

BACKGROUND OF THE INVENTION

1. Field of the Invention

The present invention relates to a marine propulsion machine including a vertical drive shaft driven for rotation by an engine, an output gear mechanism to which the power of the drive shaft is transmitted, a propeller shaft driven for rotation by power transmitted thereto through the output gear mechanism, and a water pump driven by the drive shaft.

2. Description of the Related Art

Marine propulsion machines are known which are provided with a drive shaft including a first drive shaft interlocked with an engine, and a second drive shaft interlocked with the first drive shaft by an intermediate gear mechanism (see, for example, Japanese Patent Application Publication Nos. 5-52107, 63-97489 and 3-21589. Marine propulsion machines are also known in which a gear case is provided with water intakes formed in parts thereof on the front side of drive shafts and a water pump driven by the drive shaft sucks water through the water intakes (see, for example, Japanese Patent Application Publication Nos. 3-21589 and 5-270490).

The gear case provided with the water intakes on the front side of the drive shafts is provided with a shift rod for changing ship propelling directions on the front side of the drive shafts. In some cases it is difficult to secure a space sufficient for forming the water intakes when members are disposed and passages are formed on the front side of the drive shafts.

For example, if the water intakes are formed in a big vertical dimension to form the water takes in a predetermined area when the longitudinal dimension of the water intakes is limited to avoid positional coincidence between the shift rod and the water intakes, the upper ends of the water intakes are at a high vertical position nearly corresponding to the surface level of the water and air is liable to be sucked in together with water.

In a marine propulsion machine having a gear case having a gearing holding portion holding an output gear mechanism and provided with water intakes, a suction passage extending between the water intakes and a water pump is long and causes a large pressure loss. Therefore, the water intakes need to be formed in a large area, and the size of the gearing holding portion needs to be increased or the capacity of the water pump needs to be increased accordingly. Thus power loss caused by a drive shaft driving the large-capacity water pump increases.

The drive shaft connected to the water pump is required to be corrosion-resistant or rustproof and hence the drive shaft is made of a highly corrosion-resistant material, such as a stainless steel. Such a highly corrosion-resistant material is expensive. Therefore, increase in the length of the drive shaft made of a highly corrosion-resistant material increases the cost of the marine propulsion machine.

SUMMARY OF THE INVENTION

The present invention has been made under such circumstances and it is therefore an object of the present invention to provide a marine propulsion machine including a drive shaft means including a first drive shaft interlocked with an engine, and a second drive shaft capable of transmitting the power of the first drive shaft to an output gear mechanism, wherein the second drive shaft is disposed on a rear side of the first drive shaft to facilitate securing a space for a water intake and to avoid sucking air together with water through the water intake, and the first drive shaft for driving a water pump is formed in a short length to manufacture the marine propulsion machine at a low cost.

A marine propulsion machine in an aspect of the present invention includes: a drive shaft means rotatively driven by an engine and including a first drive shaft having a vertical center axis and interlocked with the engine, and a second drive shaft having a vertical center axis, interlocked with the first drive shaft and disposed on the rear side of the first drive shaft; a gear case normally lying beneath the surface of the water; an output gear mechanism driven by the drive shaft means and held in the gear case; a propeller shaft driven for rotation by power transmitted thereto through the output gear mechanism; and a water pump driven by the drive shaft means; wherein the first and the second drive shaft are rotatably supported on the gear case, the second drive shaft extends downward beyond a vertical position corresponding to a lower end of the first drive shaft, and the gear case is provided with an water intake through which the water pump sucks water, and at least a part of the water intake is located between the first drive shaft and the output gear mechanism with respect to a vertical direction and on a front side of the second drive shaft.

In the marine propulsion machine of the present invention, the water intake is formed in a space extending on the front side of the second drive shaft disposed on the rear side of the first drive shaft and below the first drive shaft. Therefore, the water intake can be formed in a large area to ensure that water can be taken in through the water intake at a sufficiently high rate.

In the marine propulsion machine of the present invention, the front end of each of the water intakes may be at a distance equal to the distance between the respective center axes of the first and the second drive shaft forward from the center axis of the first drive shaft with respect to a longitudinal direction.

The water intake may be formed in a large area so that the front end thereof is at the distance equal to the distance between the respective center axes of the first and the second drive shaft forward from the center axis of the first drive shaft with respect to a longitudinal direction.

A marine propulsion machine in a further aspect of the present invention includes: a drive shaft means driven by an engine and including a first drive shaft having a vertical center axis and interlocked with the engine, and a second drive shaft having a vertical center axis, interlocked with the first drive shaft and disposed on a rear side of the first drive shaft; a gear case normally lying beneath the surface of the water; an output gear mechanism driven by the drive shaft means and held in the gear case; a propeller shaft driven for rotation by power transmitted thereto through the output gear mechanism; and a water pump driven by the drive shaft means; wherein the gear case is provided with at least one water intake through which the water pump sucks water, and at least a part of the lower end of the water intake is at a vertical position on a front side of the output gear mechanism and coinciding with that of an input gear included in the output gear mechanism.

The upper end of the water intake can be formed at a low vertical position because the water intake is formed in a space extending on the front side of the output gear mechanism with the lower ends thereof at a vertical position coinciding with that of the input gear. Therefore, the water intake is not liable to rise above the surface of the water, suction of air through the water intakes can be avoided and the engine can be properly cooled.

A marine propulsion machine in a still further aspect of the present invention includes: a drive shaft means driven by an engine and including a first drive shaft having a vertical center axis and interlocked with the engine, and a second drive shaft having a vertical center axis, interlocked with the first drive shaft and disposed on a rear side of the first drive shaft; a gear case normally lying beneath the surface of the water; an output gear mechanism driven by the drive shaft means and held in the gear case; a propeller shaft driven for rotation by power transmitted thereto through the output gear mechanism; and a water pump driven by the drive shaft means; wherein the second drive shaft extends downward beyond a vertical position corresponding to a lower end of the first drive shaft, and the water pump is combined with the first drive shaft.

Thus the second drive shaft is interlocked with the output gear mechanism at a vertical position below the first drive shaft. Therefore, the length of the first drive shaft is shorter than a length in which the first drive shaft is formed when the first drive shaft is directly interlocked with the output gear mechanism. Since the first drive shaft combined with the water pump and required to be formed of an expensive corrosion-resistant material is short, and the cost thereof can be reduced accordingly. The second drive shaft may be formed of an inexpensive ordinary ferrous material. Thus the marine propulsion machine can be manufactured at low cost.

DESCRIPTION OF THE PREFERRED EMBODIMENTS

Preferred embodiments of the present invention will be described with reference to FIGS. 1 to 7.

Figure 1:
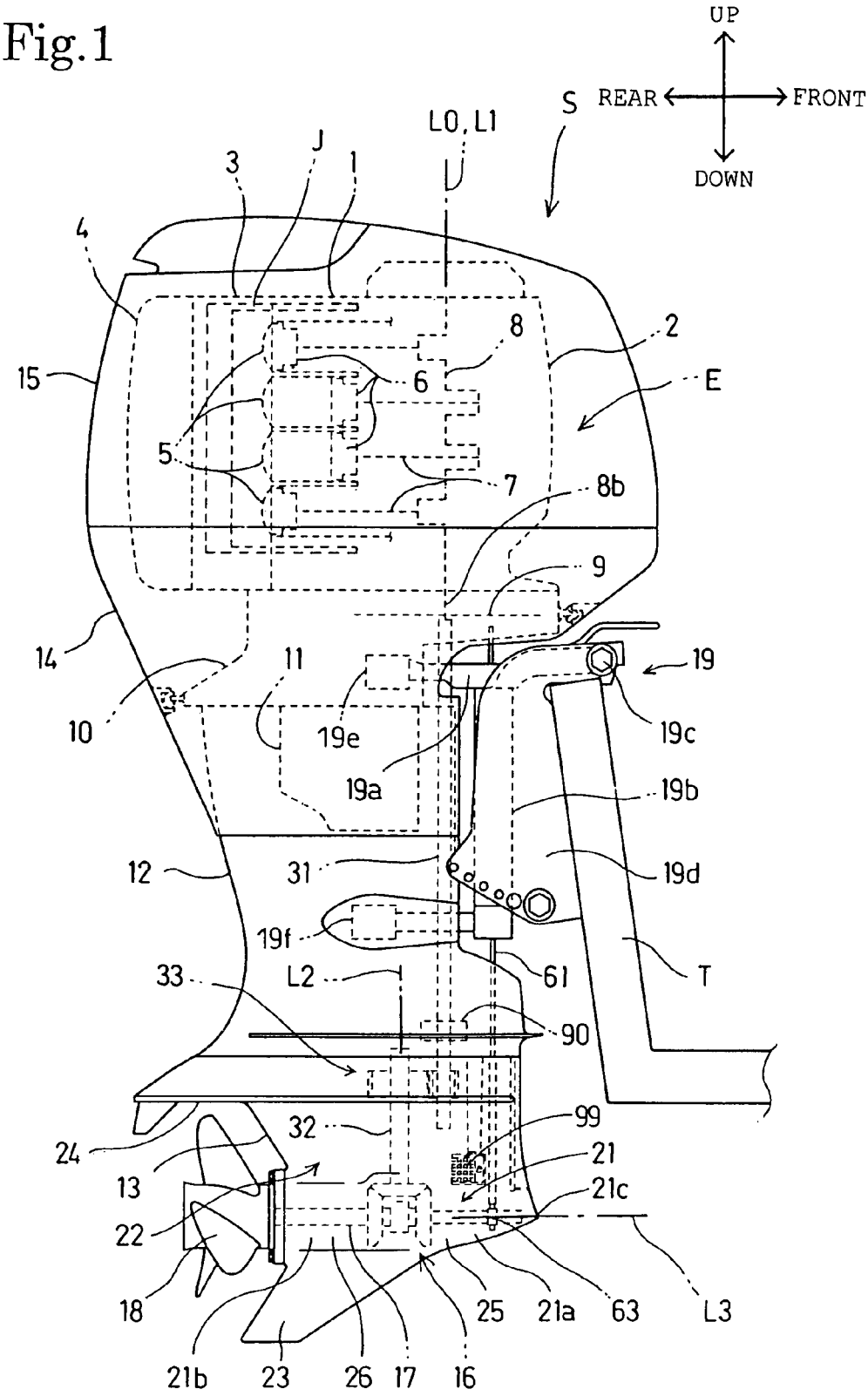
FIG. 1 is a schematic side elevation of an outboard motor in a preferred embodiment of the present invention taken from the right side of the outboard motor.

Referring to FIG. 1, an outboard motor S, namely, a marine propulsion machine, embodying the present invention has a propulsion device and a mounting device 19 for mounting the propulsion device on a hull T. The propulsion device includes an internal combustion engine E, a propulsion unit provided with a propeller 18 driven by the internal combustion engine E to generate thrust, an oil pan 11, cases 12 and 13, and covers 14 and 15.

The internal combustion engine E is a vertical, water-cooled, multicylinder 4-stroke internal combustion engine. The internal combustion engine E is provided with a crankshaft 8 disposed with its center axis L0 vertically extended, and an overhead-camshaft valve train. The internal combustion engine E has an engine body including a cylinder block 1 integrally provided with four cylinders arranged in a row, pistons 6 fitted in the cylinders for reciprocation, a crankcase 2 joined to the front end of the cylinder block 1, a cylinder head 3 joined to the rear end of the cylinder block 1, and a head cover 4. The crankshaft 8 is rotatably supported on the cylinder block 1 and the crankcase 2. The pistons 6 are interlocked with the crankshaft 8 by connecting rods 7, respectively. The pistons 6 are driven by the pressure of combustion gas produced in combustion chamber 5 formed in the cylinder head 3 to drive the crankshaft 8 for rotation through the connecting rods 7.

Figure 2:
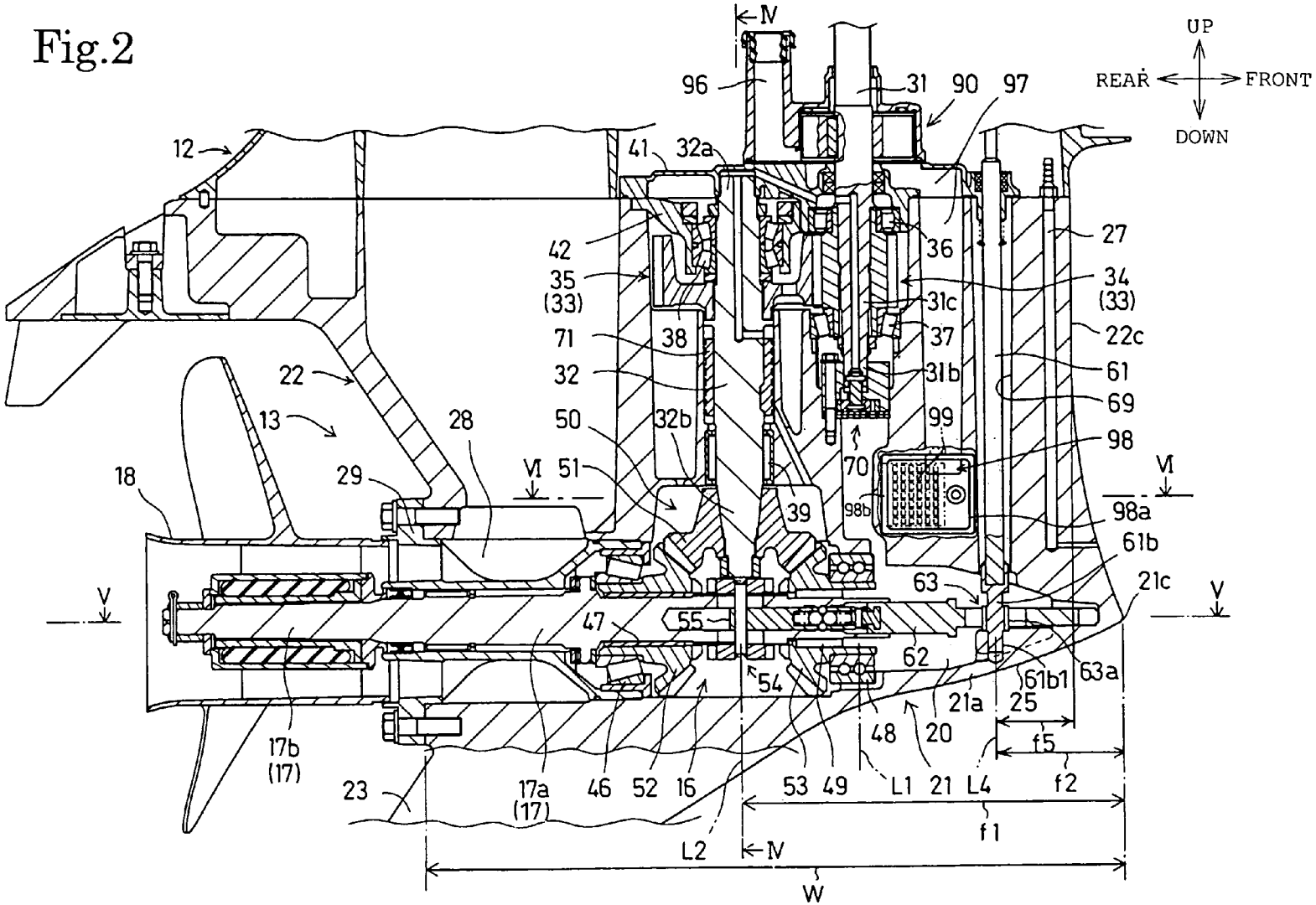
FIG. 2 is a sectional view of an essential part of the outboard motor shown in FIG. 1 taken in a plane containing the respective center axes of first and second drive shafts.

In this specification and appended claims, vertical directions are parallel to the center axes of drive shafts 31 and 32 shown in FIGS. 1 and 2, and a longitudinal directions and transverse directions are in a horizontal plane perpendicular to the vertical directions. In a horizontal plane, the transverse directions are perpendicular to the center axis of a propeller shaft. In this embodiment, vertical directions, longitudinal directions and transverse directions correspond to vertical directions, longitudinal directions and transverse directions with respect to the hull.

The internal combustion engine E is joined to the upper end of a mount case 10. The oil pan 11 and the extension case 12 surrounding the oil pan 11 are joined to the lower end of the mount case 10. The gear case 13 is joined to the lower end of the extension case 12. A lower part of the internal combustion engine E, the mount case 10 and an upper part of the extension case 12 are covered with an under cover 14. An engine cover 15 is joined to the upper end of the under cover 14 so as to cover the internal combustion engine E. The under cover 14 and the engine cover 15 define an engine compartment for containing the internal combustion engine E.

A first drive shaft 31 is connected to a lower end part 8*b* of the crankshaft 8 through a flywheel 9 coaxially with the crankshaft 8. The first drive shaft 31 has a vertical center axis L1 aligned with the center axis of the crankshaft 8. The first drive shaft 31 is driven for rotation by the crankshaft 8. The first drive shaft 31 extends downward from the lower end part 8*b* of the crankshaft 8 through the mount case 10 and the extension case 12 into the gear case 13. A second drive shaft 32 is supported in a vertical position on the gear case 13. The second drive shaft 32 has a vertical center axis L2 parallel to the center axis of the first drive shaft 31. The second drive shaft 32 is connected through a reversing mechanism 16 to a propeller shaft 17 holding the propeller 18, namely, a thrust generating means. The reversing mechanism 16 is capable of changing the input speed to provide an output speed. The power of the internal combustion engine E is transmitted from the crankshaft 8 through the drive shafts 31 and 32, the reversing mechanism 16 and the propeller shaft 17 to the propeller 18 to drive the propeller 18 for rotation.

The propulsion unit includes the drive shafts 31 and 32, the reversing mechanism 16, the propeller shaft 17 and the propeller 18.

The mounting device 19 for mounting the outboard motor S on the stern of a hull T has a swivel shaft 19*a* fixed to the mount case 10 and the extension case 12, a swivel case 19*b* supporting the swivel shaft 19*a* for turning thereon, a tilting shaft 19*c* supporting the swivel case 12 so as to be turnable in a vertical plane, and a bracket 19*d* holding the tilting shaft 19*c* and attached to the stern of the hull T. The swivel shaft 19*a* has an upper end part fixed through a mount rubber 19*e* to the mount case 10, and a lower end part fixed through a mount rubber 19*f* to the extension case 12. The mounting device 19 holds the outboard motor S so as to be turnable on the tilting shaft 19*c* in a vertical plane relative to the hull T and so as to be turnable on the swivel shaft 19*a* in a horizontal plane.

Referring to FIGS. 1 and 2, the gear case 13 has a gearing holding portion 21 defining a gear chamber 20 (FIG. 2) for containing the reversing mechanism 16 and the propeller shaft 17, a support portion 22 extending upward from the gearing holding portion 21 and connected to the extension case 12, a skeg 23 extending downward from the gearing holding portion 21, and an anticavitation plate 24 horizontally extending from an upper part of the support portion 22. While the ship is cruising, the anticavitation plate 24 is substantially at the level of the water surface, and the gearing holding portion 21 and the support portion 22 are beneath the water level. The gearing holding portion 21 has a streamline shape resembling an artillery shell. The support portion 22 has a cross section having a streamline shape resembling a cross section of a wing, in a horizontal plane perpendicular to the respective center axes L1 and L2 of the drive shafts 31 and 32.

The first drive shaft 31 is supported in a vertical position in bearings 36 and 37 on the support portion 22. The second drive shaft 32 is supported in a vertical position in bearings 38 and 39 on the support portion 22. An oil pump 70 is built in the support portion 22. The support portion 22 is provided with a bore 69 for receiving a shift rod 61, a suction passage 97 for carrying water to a water pump 90, and a pressure bore 27 for measuring water pressure to determine cruising speed. The water pump 90 sucks cooling water and supplies the cooling water by pressure to water jackets J formed in the cylinder block 1 and the cylinder head 3 of the internal combustion engine E.

Figure 3:
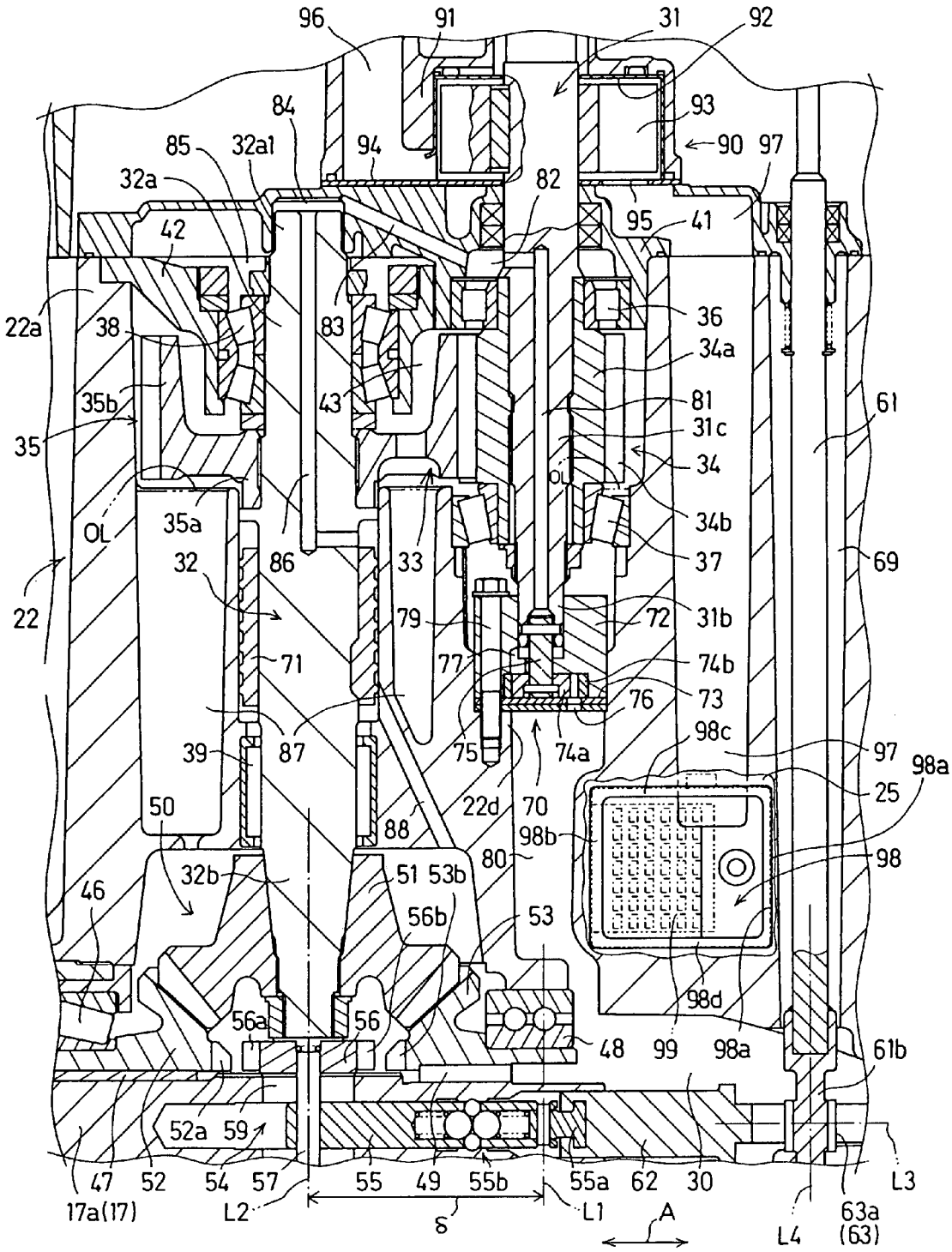
FIG. 3 is an enlarged view of a part shown in FIG. 2.

Referring to FIGS. 2 and 3, the first drive shaft 31 has an upper end part connected to the crankshaft 8 (FIG. 1). The second drive shaft 32 is interlocked with the first drive shaft 31 by an intermediate gear mechanism 33. The second drive shaft 32 transmits the power of the first drive shaft 31 to an output gear mechanism 50. The second drive shaft 32 is disposed behind the first drive shaft. The center axis L1 of the first drive shaft 31 is aligned with the center axis L0 of the crankshaft 8 of the internal combustion engine E. The center axis L2 of the second drive shaft 32 is parallel to the center axis L1 of the first drive shaft 31 and is separated longitudinally rearward from the center axis L1 of the first drive shaft 31 by a distance δ. The second drive shaft 32 is disposed substantially at the middle of the gearing holding portion 21; that is, the center axis L2 of the second drive shaft 32 is nearer to a vertical line bisecting the length W (FIG. 2), namely, the longitudinal dimension, of the gearing holding portion 21 than the center axis L1 of the first drive shaft 31. The second shaft 32 extends downward beyond a vertical position corresponding to the lower end of the first drive shaft 31. The center axes L1 and L2 are contained in a vertical plane containing the center axis L3 (FIGS. 1 and 3) of the propeller shaft 17.

The first drive shaft 31 provided with the water pump 90 is wetted with water. Therefore, the first drive shaft 31 is made of a highly corrosion-resistant material, such as a stainless steel. The second drive shaft 32 is exposed to oil and an oil-containing atmosphere. Therefore, the second drive shaft 32 is made of a material less corrosion-resistant than the material of the first drive shaft 31. The second drive shaft 32 is made of a low-cost ferrous material, such as a machine-structural carbon steel, for example, SCM415, Japan Industrial Standards. Thus the second drive shaft 32 can be manufactured at low cost.

The intermediate gear mechanism 33, namely, an interlocking mechanism, includes a drive gear 34 mounted on the first drive shaft 31 and interlocked with the first drive shaft 31 by splines, and a driven gear 35 mounted on the second drive shaft 32, meshed with the drive shaft 34 and interlocked with the second drive shaft 32 by splines.

The first drive shaft 31 extending through the extension case 12 has a lower part 31*c* extending in the support portion 22. The drive gear 34, namely, a driving interlocking member, is mounted on the lower end part 31*c*. A lower end part 31*b* of the first drive shaft 31 extends downward from the drive gear 34. The lower end part 31*b* extends substantially in a middle part of a vertical range between the propeller shaft 17 and the water pump 90 or substantially in a middle part of the support portion 22. The first drive shaft 31 is supported in the bearing 36 on the upper side of the boss 34*a* of the drive gear 34 and the bearing 37 on the lower side of the boss 34*a* of the drive gear 34.

The upper bearing 36 is a roller bearing. The lower part 31*c* of the first drive shaft 31 is supported through an upper part of the boss 34*a* by the upper bearing 36. The upper bearing 36 is held immediately above a toothed part 34*b* of the drive gear 34 on the support portion 22 by a bearing holder 41. The lower bearing 37 is a taper roller bearing. The lower part 31*c* of the first drive shaft 31 is supported by the lower bearing 37 through a lower part of the boss 34*a*. The lower bearing 37 is held immediately below the toothed part 34*b* on the support portion 22.

The second drive shaft 32 is substantially entirely contained in the support portion 22. The second drive shaft 37 has an upper end part 32*a* extending upward from the boss 35*a* of the driven gear 35, namely, a driven interlocking member, and a lower end part 34*b* extending in the gear chamber 20. The lower end part 34*b* of the second drive shaft 32 is the input member of the output gear mechanism 50. The second drive shaft 32 is supported only in the bearings 38 and 39 disposed on the upper and the lower side, respectively, of the driven gear 35 with respect to the vertical direction.

The upper bearing 38 is a double-row taper roller bearing with vertex of contact angles outside of the bearing and is capable of sustaining both upward and downward axial loads. An upper end part 32*a* of the second drive shaft 34 extending upward from the region of the driven gear 35 is supported in the upper bearing 38. The upper bearing 38 is held immediately above the boss 35*a* of the driven gear 35 by a bearing holder 42 joined to an upper end part 22*a* of the support portion 22. The lower bearing 39 is a needle bearing. The lower bearing 39 supports the second drive shaft 32 and is held on the support portion 22 at a position immediately above the lower end part 32*b* of the second drive shaft 34.

The upper bearing 38, the boss 34*a* of the drive gear 34 and the toothed part 34*b* are substantially at the same vertical position with respect to the vertical direction in which the second drive shaft 34 extends. The upper bearing 38 and the cylindrical toothed part 35*b* of the driven gear 35 are substantially at the same vertical position with respect to the vertical direction. The upper bearing 38 is disposed in a cylindrical space 43 extending between the upper end part 32*a* and the toothed part 35*b* and surrounded by the toothed part 35*b*. The lower bearing 39 is put on a part of the lower end part 32*b* extending above an input gear 51 mounted on the lower end part 32*b*.

As shown in FIG. 2, the propeller shaft 17 is rotatably supported by a bearing holder 29 in the gearing holding portion 21 with its center axis L3 longitudinally extended. The propeller shaft 17 is driven for rotation by power transmitted thereto by the output gear mechanism 50. The propeller shaft 17 has a front part 17*a* extending in the gearing holding portion 21 or the gear chamber 20, and a rear part 17*b* extending to the outside of the gearing holding portion 21 and holding the propeller 18.

As best shown in FIG. 3, the reversing mechanism 16 includes the output gear mechanism 50 and a clutch 54 for changing the rotational direction of the propeller shaft 17.

The output gear mechanism 50 driven by the second drive shaft 32 is disposed in the gear chamber 20. The gear chamber 20 is a sealed space filled with oil. The output gear mechanism 50 includes an input gear 51 mounted on the lower end part 32*b* of the second drive shaft 32, a forward gear 52 and a reverse gear 53. The forward gear 52 and the revere gear 53 are on the rear side and the front side, respectively, of the clutch 54. The output gear mechanism 50 is a bevel gear mechanism. In this embodiment, the output gear mechanism 50 is a standard rotation type gear mechanism. The forward gear 52 is supported by bearings 46 and 47 on the front part 17*a* at a position behind the center axis L2 aligned with the center axis of the input gear 51 and the center axis of the lower end part 32*b*. The reverse gear 53 is supported by bearings 48 and 49 on the front part 17*a* at a position in front of the center axis L2.

The intermediate gear mechanism 33 and the output gear mechanism 50 are a primary reduction gear mechanism and a secondary reduction gear mechanism, respectively, of a transmission system including the first drive shaft 31, the second drive shaft 32 and the propeller shaft 17. The reduction ratio of the intermediate gear mechanism 33 is higher than that of the output gear mechanism 50. For example, the reduction ratio of the intermediate gear mechanism 33 is between 1.6 and 2.5, while that of the output gear mechanism 50 is between 1.0 and 1.4. Therefore, the reduction ratio of the output gear mechanism 50 may be low as compared with a reduction ratio required when the intermediate gear mechanism 33 is omitted. Thus the respective diameters of the forward gear 52 and the reverse gear 53 are small, the diameter of the gearing holding portion 21 may be small and hence the gear case 13 may be small.

Figure 4:
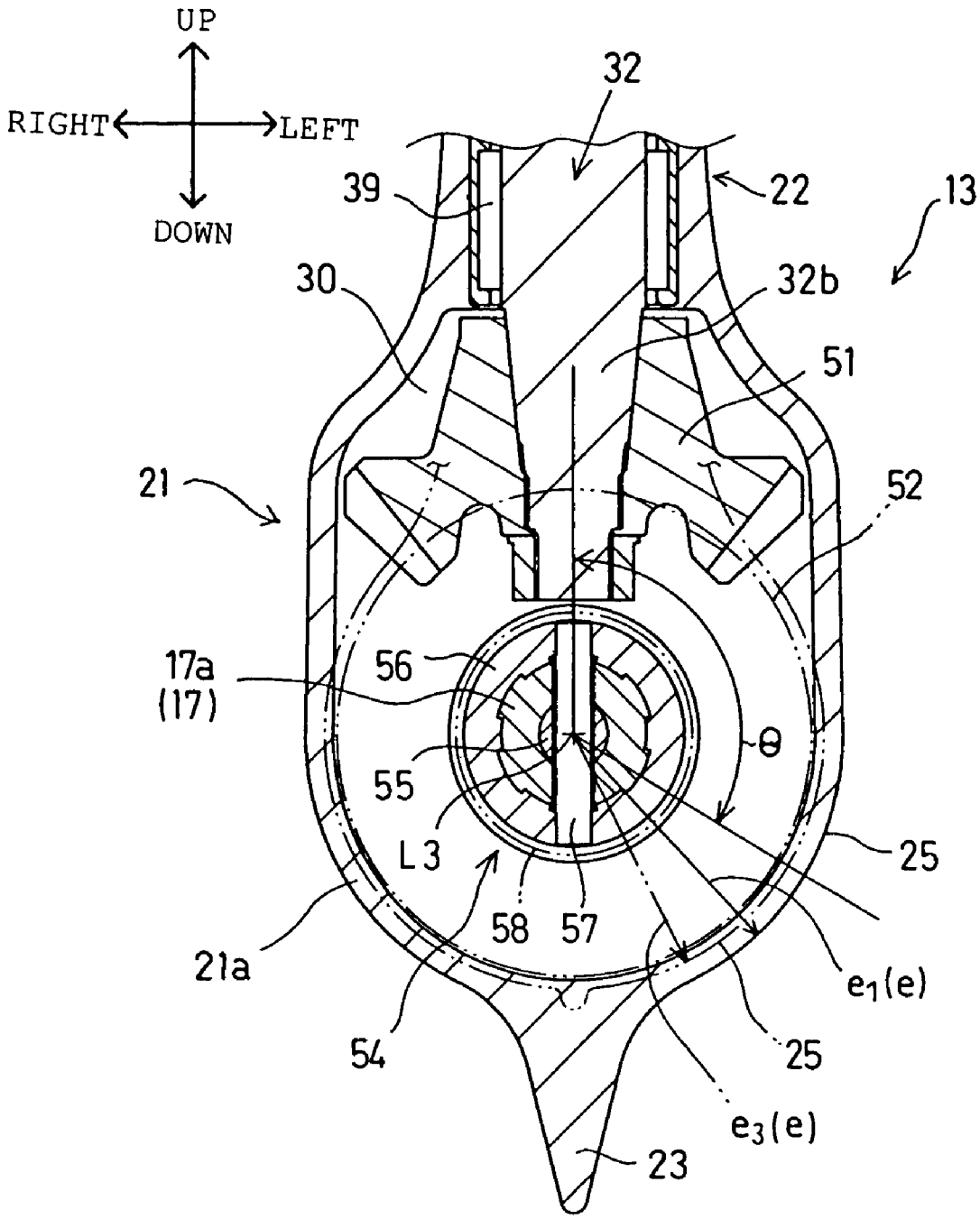
FIG. 4 is a sectional view taken on the line IV-IV in FIG. 2.
Figures 5A, 5B:
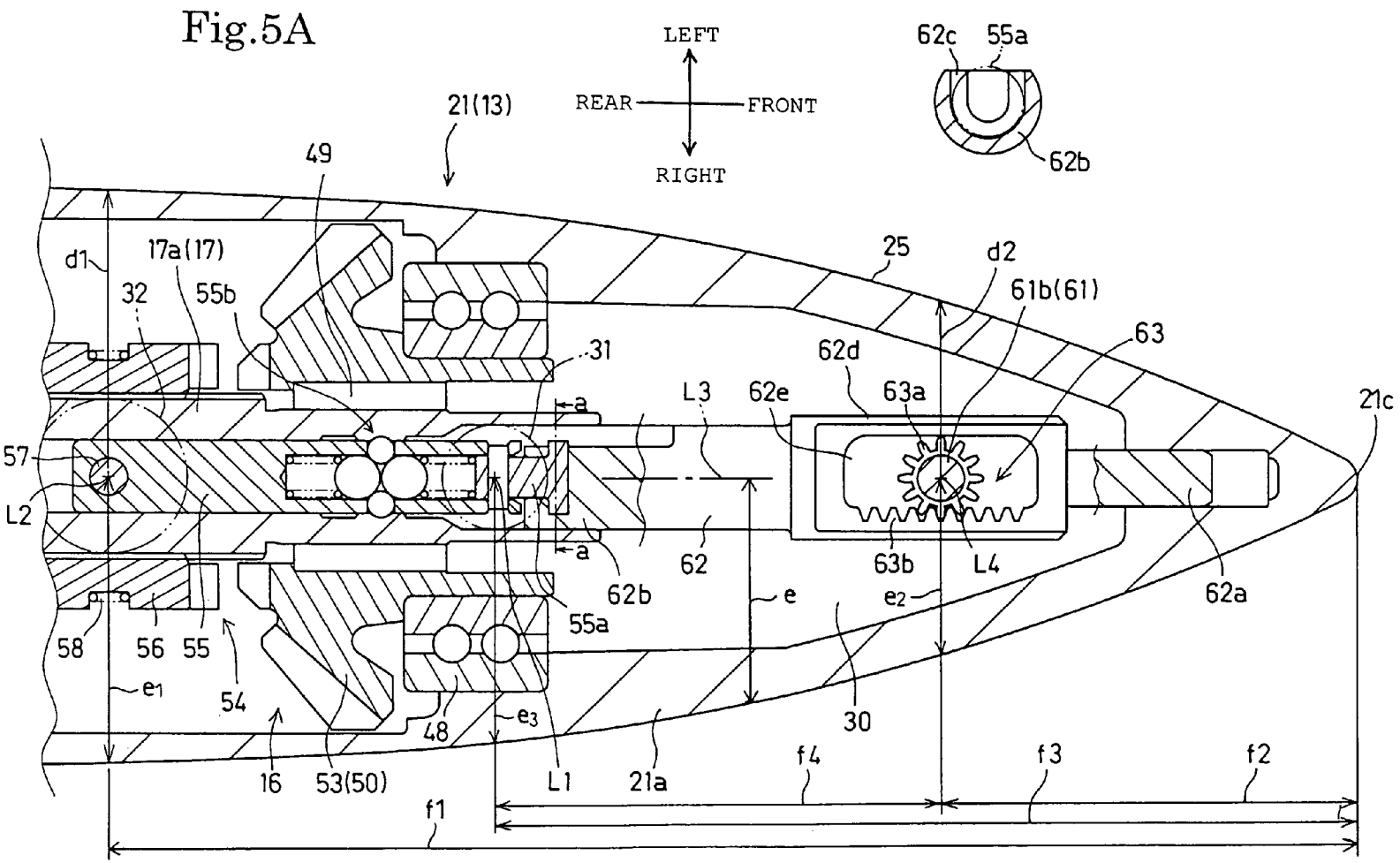
FIG. 5A is a sectional view taken on the line V-V in FIG. 2.
FIG. 5B is a sectional view taken on the line a-a in FIG. 5A.

Referring to FIGS. 4, 5A and 5B, the clutch 54 includes a shifter 55 fitted in an axial bore formed in the front part 17*a* so as to be axially slidable in directions parallel to the center axis L3 of the propeller shaft 17, a cylindrical clutch element 56 put on the front part 17*a*, and a connecting pin 57 retained in place by a coil spring 58 to connect the shifter 55 and the clutch element 56.

The shifter 55 is moved in directions A (FIG. 3) parallel to the center axis L3 by operating the shift rod 61. The shifter 55 has a connecting part 55*a* connected to an operating rod 62 so as to be rotatable and movable in the directions A, and a detent mechanism 55*b*, namely, a positioning mechanism, for retaining the shifter 55 of the clutch mechanism 54 at a neutral position, a forward position or a reverse position. As shown in FIG. 3, the connecting pin 57 is passed through a pair of slots 59 formed in the front part 17*a* and parallel to the center axis L3. The connecting pin 57 has opposite end parts connected to the clutch element 56. The clutch element 56 is interlocked with the front part 17*a* by splines so as to be slidable in the directions A on the front part 17*a*. The clutch element 56 is a movable member of a dog clutch. The clutch element 56 has a forward interlocking part 56*a* provided with teeth capable of being engaged with teeth formed on the forward gear 52 formed on one end thereof and a reverse interlocking part 56*b* provided with teeth capable of being engaged with teeth of the reverse gear 53 formed on the other end thereof.

When the shifter 55 is positioned at the neutral position by operating the shift rod 61, the clutch element 56 is not interlocked with either of the forward gear 52 and the reverse gear 53, and hence any power is transmitted through the first drive shaft 31 and the second drive shaft 32 to the propeller shaft 17. When the shifter 55 is positioned at the forward position, the clutch element 56 is interlocked with the forward gear 52. Consequently, power is transmitted through the first drive shaft 31, the second drive shaft 32, the forward gear 52 and the clutch element 56 to the propeller shaft 17 to propel the ship forward by rotating the propeller 18 in the normal direction. When the shifter 55 is positioned at the reverse position, the clutch element 56 is interlocked with the reverse gear 53. Consequently, power is transmitted through the first drive shaft 31, the second drive shaft 32, the reverse gear 53 and the clutch element 56 to the propeller shaft 17 to propel the ship rearward by rotating the propeller 18 in the reverse direction.

Referring to FIGS. 1 to 3 and 5A, a clutch control mechanism for controlling the clutch mechanism 54 includes the shift rod 61, namely, an operating member, to be turned by a drive mechanism, not shown, operated by the operator, and the operating rod 62 to be driven through an interlocking mechanism 63 by the shift rod 61 to control the clutch mechanism 54.

The shift rod 61 held in the bore 69 of the gear case 13 lies in front of the first drive shaft 31 and vertically extends through the support portion 22 into the gearing holding portion 21 (FIG. 1). The shift rod 61 has a lower end part 61*b* extending in the gear chamber 20 (FIG. 2). A lowermost part 61*b*1 of the shift rod 61 is slidably and rotatably supported on the gearing holding portion 21. A pinion 63*a* is mounted on the lower end part 61*b*.

The operating rod 62 has a front end part 62*a* slidably and rotatably fitted in a bore formed in a part of the gearing holding portion 21 near the front end 21*c* of the gearing holding portion 21, and a rear end part 62*b* connected to the connecting part 55*a* of the shifter 55. The operating rod 62 has a slotted middle part 62*d* provided with a slot 62*e* opening in vertical directions, and extending between the front end part 62*a* and the rear end part 62*b*. The slotted middle part 62*d* is provided in the inside surface of one of the longitudinal side parts thereof with a rack 63*b* (FIG. 5A). The pinion 63*a* is in mesh with the rack 63*b*.

The interlocking mechanism 63 includes the pinion 63*a*, namely, a driving member, and the rack 63*b*, namely, a driven member.

When the shift rod 61 is turned, the pinion 63*a* turns to move the rack 63*b* forward or rearward (in either of the directions A parallel to the center axis L3). Thus the operating rod 62 moves the shifter 55 in an axial direction to place the shifter 55 selectively at the neutral position, the forward position or the reverse position. More concretely, the shifter 55 is at the neutral position in FIGS. 3 and 5A. When the shift rod 61 is turned to turn the pinion 63*a* clockwise in the state shown in FIG. 5A, the operating rod 62 provided with the rack 63*b* is moved rearward to position the shifter 55 at the forward position. When the shift rod 61 is turned to turn the pinion 63*a* counterclockwise in the state shown in FIG. 5A, the operating rod 62 provided with the rack 63*b* is moved forward to position the shifter 55 at the reverse position.

A recessed part 62*c* (FIG. 5B) of the operating rod 62 allows the operating rod 62 to be connected to the connecting part 55*a* at two different angular positions of the operating rod 62 around its axis L3. Therefore, the rack 63*b* can be disposed either on the right side or on the left side of the pinion 63*a*. Therefore, change of the twisting direction of the blades of the propeller 18 or the reversing of the rotating direction of the first drive shaft 31 or the second drive shaft 32 can be dealt with by changing the mode of connection of the operating rod 62 to the shifter 55 and hence the forward cruising and reverse cruising of the ship can be controlled without changing the turning directions of the shift rod 61 respectively for forward cruising and reverse cruising.

Referring to FIGS. 1 and 2, the gearing holding portion 21 is divided into a tapered part 21*a* and a cylindrical part 21*b* substantially by a vertical plane which contains the center axis L2 and is perpendicular to the center axis L3. The tapered part 21*a* extends forward from the region of the second drive shaft 32 to the front end 21*c* of the gearing holding portion 21.

The cylindrical part 21*b* extends rearward from the region of the second drive shaft 32 to the rear end of the gearing holding portion 21. Referring to FIGS. 4 and 5, the tapered part 21*a* has a generally tapered shape and has diameter decreasing with distance in a direction from the second drive shaft 32 toward the front end 21*c*, and the cylindrical part 21*b* has a generally cylindrical shape and has a fixed diameter.

In this specification, "generally tapered" signifies that the tapered part 21*a* is substantially tapered and may include local irregularities, and "generally cylindrical" signifies that the cylindrical part 21*b* is substantially cylindrical and may have local irregularities. Joints (merging parts) between the gearing holding portion 21 and the support portion 22 and between the gearing holding portion 21 and the skeg 23 are excluded from the tapered part 21*a* and the cylindrical part 21*b*.

More concretely, the radii e (FIG. 4) of parts on the intersection of the outside surface 25 of the tapered part 21*a* and a plane at an angle θ from a vertical plane containing the center axis L3 (a datum plane), namely, distances from the center axis L3 to parts on the intersection of the outside surface 25 of the tapered part 21*a* and a plane at an angle θ from a vertical plane containing the center axis L3 (a datum plane), farther forward from the center axis L2 are smaller. The greatest radius $e_1$ among the radii e of the tapered part 21*a* is substantially dependent on the size of the output gear mechanism 50 held in the gearing holding portion 21, namely, the diameters of the gears 51 to 53. Therefore, a part of the outside surface 25 of the tapered part 21*a* corresponding to the center axis L2 has the greatest radius $e_1$. The radii e of parts of the tapered part 21*a* extending in front of the second drive shaft 32 including the radius $e_3$ of a part corresponding to the center axis L1 of the first drive shaft 31 aligned with the center axis of the connecting pin 57 at the neutral position, and the radius $e_2$ of a part corresponding to the center axis L4 of the shift rod 61 decrease toward the front end 21*c*. In FIG. 4, the circumference of the outside surface 25 in a vertical plane containing the center axis L1 of the first drive shaft 31 and perpendicular to the center axis L3 is indicated by a two-dot chain line. Cross sections of the tapered part 21*a* excluding that of a part corresponding to the input gear 51 are circles.

The cross section is a section in a plane perpendicular to the longitudinal direction, namely, a direction in which water flows when the ship cruises straight. A cross-sectional area is the area of a cross section.

Thus the distance from the front end 21*c* to the part having the greatest radius $e_1$ of the tapered part 21*a* of the gear case 13 of the outboard motor S in this embodiment is longer than that from the front end to a part having the greatest radius of the gear case (comparative gear case) of an outboard motor having a single drive shaft at a position corresponding to that of the first drive shaft 31. In other words, the distance from the front end 21*c* to the part having the greatest radius $e_1$ is longer than that in the case of the comparative gear case by the distance δ by which the center axis L2 of the second drive shaft 32 is separated longitudinally rearward from the center axis L1 of the first drive shaft 31. Therefore, the tapered part 21*a* of the gear case 13 has a taper ratio smaller than that of the tapered part of the comparative gear case. Thus the tapered part 21*a* is tapered in a small or gentle taper. The radius e of the tapered part 21*a* increases more gradually from the front end 21*c* toward the part corresponding to the second drive shaft 32 than that of the tapered part of the comparative gear case, and hence the cross-sectional area of the tapered part 21*a* increases gradually from the front end 21*c* toward the part corresponding to the second drive shaft 32. Thus, it is possible to provide a low "shape resistance" (hereinafter referred to as "underwater resistance") resulting from the shape of the gear case 13 while the ship is cruising forward.

In this specification, the term "taper ratio" is the ratio of the axial distance f1 between the front end 21*c* and the center axis L2 of the second drive shaft 32 corresponding to the part having the greatest radius $e_1$, to the greatest radius $e_1$, i.e. $f1/e_1$.

Referring to FIG. 5A, the shape of the tapered part 21*a* is defined by the following expressions.

$R2=f2/f1$ $R3=f3/f1$ $R4=f4/f1$ $R5=e_2/e_1$ $R6=e_3/e_1$ where f1 is the axial distance between the front end 21*c* and the center axis L2 of the second drive shaft 32 corresponding to the part having the greatest radius $e_1$, f2 is the axial distance between the front end 21*c* and the center axis L4 of the shift rod 61, f3 is the axial distance between the front end 21*c* and the center axis L1 of the first drive shaft 31, f4 is the axial distance between the center axis L4 of the shift rod 61 and the center axis L1 of the first drive shaft 31, $e_1$ is the greatest one of the radii e of the tapered part 21*a*, and $e_2$ is the radius of the part corresponding to the center axis L4 of the shift rod 61. The axial distance f2 satisfies an inequality: 20%≦R2≦45%, preferably, R2=34%. The radius $e_2$ satisfies an inequality: 58%≦R5≦69%, preferably, R5=63%.

The axial distance f3 satisfies an inequality: 60%≦R3≦80%, preferably, R3≈68% (when the axial distance satisfies that condition, the axial distance f4 satisfied R4≈36%). The radius $e_3$ of the part corresponding to the center axis L1 satisfies an inequality: 89%≦R6≦97%, preferably, R6=93%.

The distance between the center axis L3 to an optional part on the outside surface 26 (FIG. 1) of the cylindrical part 21*b* is approximately equal to the greatest radius $e_0$. A cross section of the cylindrical part 21*b* has a circular shape.

In the gearing holding portion 21 holding the output gear mechanism 50, the propeller shaft 17 and the interlocking mechanism 63, the axial distance between the center axis L2 of the second drive shaft 32 having the lower end part 32*b* in engagement with the output gear mechanism 50, and the center axis L4 of the shift rod 61 is greater than the outside diameter d1 (FIG. 5A) of a part of the gearing holding portion 21 corresponding to the center axis L2. The outside diameter d1 of the part corresponding to the center axis L2 is the greatest one of those of the tapered part 21*a*.

As best shown in FIG. 5A, the decreasing rate of the radius e in an axial range between the center axis L1 of the first drive shaft 21 and the front end 21*c* is higher than that at which the radius e decreases in an axial range between the center axis L2 of the second drive shaft 32 and the center axis L1 of the first drive shaft 31.

The axial distance f2 between the front end 21*c* and the center axis L4 of the shift rod 61 is not smaller than the diameter d2 of a part of the tapered part 21*a* corresponding to the center axis L4 ($2e_2$) and not greater than $2.5e_2$.

Since the second drive shaft 32 is separated rearward from the first drive shaft 31, the axial distance between the second drive shaft 32 and the front end of the support portion 22 is long relative to the outside diameter as compared with the corresponding axial distance in the comparative gear case. Thus the support portion 22, similarly to the gearing holding portion 21, can be formed in a tapered shape, the support portion 22 is gradually tapered toward its front end and hence the cross-sectional area of the holding part 22 increases gradually from the front end rearward.

Referring to FIG. 2, the gear case 13 is turned around the shift rod 61 for steering. Therefore a part of the gear case 13 extending forward from the center axis L4 of the shift rod 61 to the front ends 21*c* and 22*c* is a front overhang. The shape of the front overhang has a significant influence on the high-speed cruising performance of the ship and response to steering operations. The overhang extending slightly below the anticavitation plate 24 is designed such that the axial distance f2 between the front end 21*c* and the center axis L4 of the shift rod 61 is in a range between a distance equal to the axial distance f5 between the center axis L4 and the front end 22*c* of the support portion 22 and a distance about twice the distance f5. The front ends 21*c* and 22*c* are shaped such that the front end 22*c* is connected by a substantially straight line to the front end 21*c* when the distance f2 is equal to the distance f5 or by a continuous curve when the distance f2 is longer than the distance f5.

A lubricating system for lubricating the moving parts disposed in the gear case 13 and requiring lubrication including the bearings 36, 37, 38 and 39 and the intermediate gear mechanism 33 will be described with reference to FIGS. 2 and 3.

The lubricating system includes the oil pump 70, namely, a first oil pump, driven by the first drive shaft 31, a screw pump 71, namely, a second oil pump, and oil passages. The oil pump 70 is a trochoid pump. The oil pump 70 is disposed at a vertical position substantially coinciding with that of the screw pump 71 between the output gear mechanism 50 and the intermediate gear mechanism 33 with respect to a vertical direction The oil pump 70 includes a pump body 72 fixedly held in the support portion 22 and having a recess opening downward, a rotor unit disposed in the recess of the pump body 72 and including an inner rotor 74*a* and an outer rotor 74*b*, a pump cover 73 seated on a shoulder 22*d* formed in the support portion 22 so as to cover the rotors 74*a* and 74*b*, and a pump shaft 75 connected to a lower end part 31*b* of the first drive shaft 31 and the inner rotor 74*a*. The pump cover 73 and the pump body 72 contiguous with the pump cover 73 are fastened to the shoulder 22*d* with bolts 79. The pump cover 73 and the pump body 72 are provided with a suction port 76 and a discharge port 77, respectively.

The oil passages include a suction passage 80 formed in the support portion 22 to carry oil from the gear chamber 20 to the suction port 76, a discharge passage 81 formed in the first drive shaft 31 and connected to the discharge port 77, an oil chamber 82 defined by the support portion 22 and the bearing holder 41 and holding the upper bearing 36 therein, an oil passage 83 formed in the bearing holder 41, an oil chamber 84 formed in the bearing holder 41, an oil chamber 85 defined by the bearing holders 41 and 42 and holding the upper bearing 38 therein, two return passages 87 and 88 formed in the support portion 22 to carry oil to the oil chamber 20, and an oil passage 86 formed in the second drive shaft 32 to carry part of the oil contained in the oil chamber 84 to the screw pump 71.

An uppermost part 32*a*1 of the upper end part 32*a* of the second drive shaft 32 is inserted into the oil chamber 84. The oil passage 86 opens into the oil chamber 84. The screw pump 71 is disposed between the driven gear 35 and the lower bearing 39 and is driven by the second drive shaft 32. The screw pump 71 has a cylindrical rotor provided in its outer surface with a helical grooves twisted so as to move the oil downward when the cylindrical rotor rotates. Oil level OL of the oil contained in the gear case 13 is below the intermediate gear mechanism 33 and near the vertical position of the oil pump 70 so that the oil pump 70 can suck the oil.

When the internal combustion engine E operates and the first drive shaft 31 and the second drive shaft 32 rotate, the oil pump 70 sucks the oil through the suction passage 80 and discharges the oil through the discharge port 77 into the discharge passage 81. The oil flowing in the discharge passage 81 is pressurized by centrifugal force exerted thereon when the first drive shaft 31 rotates and is forced into the oil chamber 82 to lubricate the upper bearing 36. The oil flows downward from the oil chamber 82 to lubricate the drive gear 34, the driven gear 35 and the lower bearing 37, and then flows through an oil passage, not shown, into the return passage 87. The oil flows from the oil chamber 82 through the oil passage 83 into the oil chamber 84. Then, the oil flows from the oil chamber 84, flows through a gap between the bearing holder 41 and the upper end part 32*a* of the second drive shaft 32 into the oil chamber 85 to lubricate the upper bearing 38 and the driven gear 35, and then flows into the return passage 87. The screw pump 71 sucks part of the oil contained in the oil chamber 84 into the oil passage 86. The screw pump supplies the oil by pressure. Part of the oil supplied by the screw pump 71 lubricates the lower bearing 39 and returns into the gear chamber 20 and another part of the oil flows into the return passage 88. Thus the entire second drive shaft 32 is in the oil and an oil-containing atmosphere.

The water pump 90 is driven by the first drive shaft 31. The water pump 90 is held on the gear case 13 by the bearing holder 41. The water pump 90 includes a pump housing 91 fixed to the upper end of the bearing holder 41, and an impeller 93 placed in a pump chamber 92 defined by the pump housing 91. The impeller 93 is mounted on the first drive shaft 31. Water is sucked through an inlet port 95 formed in a gasket 94 into the pump chamber 92. Then, the impeller 93 sends out the water by pressure through an outlet port 96. Then, the water flows through a water supply passage including a conduit and pores formed in the mount case 10 into the water jackets J (FIG. 1) of the internal combustion engine E.

Figure 6:
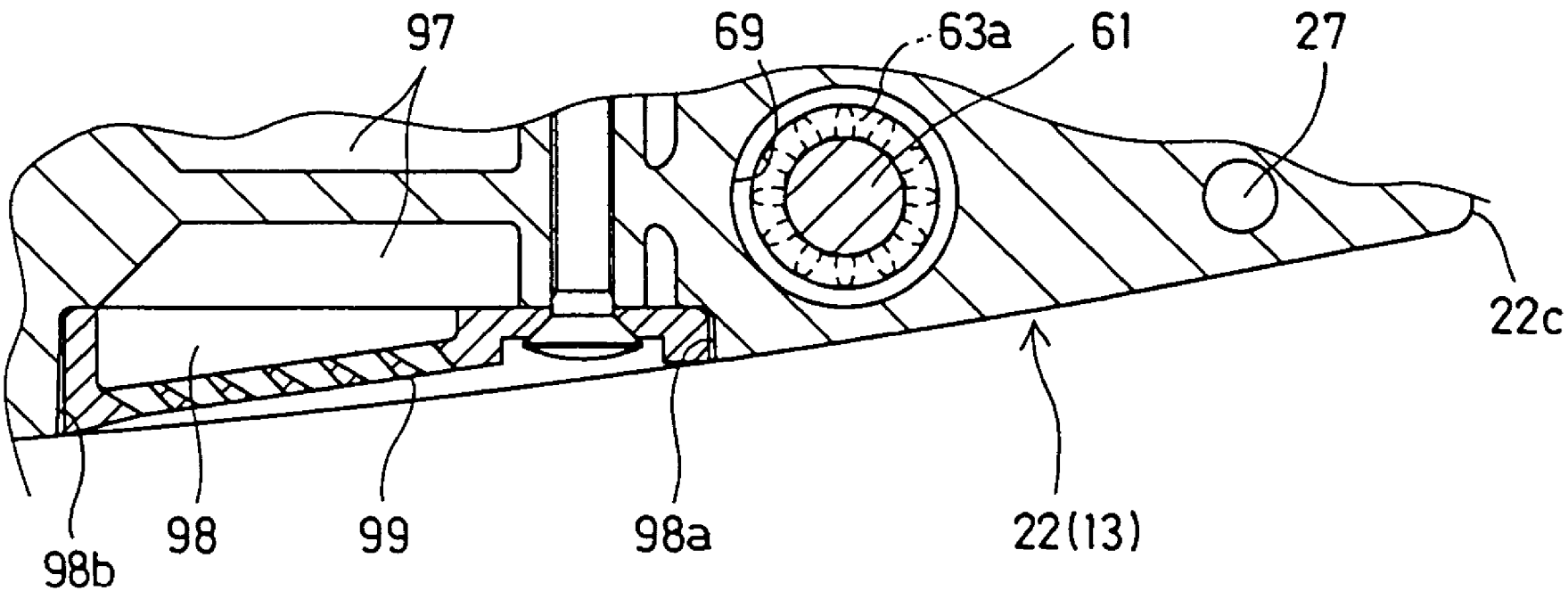
FIG. 6 is a sectional view taken on the line VI-VI in FIG. 2.

Referring also to FIG. 6, suction passages 97 are formed in the support portion 22 and the bearing holder 41 to carry cooling water to the inlet port 95. A pair of water intakes 98 are formed in the opposite side surfaces 25 of the support portion 22. Only the water intake 98 formed in the right-hand side surface 25 is shown in FIG. 6. The suction passages 97 are connected to the water intakes 98, respectively. Screens 99 are attached to the water intakes 98 to screen out foreign matters. As shown in FIG. 3, the oil pump 70 and at least a part of each of the water intakes 98 covered with the screens 99 are located between the first drive shaft 31 and the output gear mechanism 50 with respect to a vertical direction, and between the first drive shaft 31 and the shift rod 61 with respect to the longitudinal direction.

Since the lower end part 31*b* of the first drive shaft 31 is at a vertical position substantially coinciding with a middle part of the second drive shaft 32, each of the water intakes 98 is formed at a position on the front side of the second drive shaft 32 disposed behind the first drive shaft 31 and between the first drive shaft 31 and the output gear mechanism 50 with respect to the vertical direction. The upper end 98*c* of each water intake 98 is at a level below the lower end part 31*b* of the first drive shaft 31. At least a part of the lower end 98*d* of each water intake 98 is on the front side of the reverse gear 53 of the output gear mechanism 50, i.e., on the front side of the input gear 51 and the forward gear 52 of the output gear mechanism 50, and is at a vertical position substantially coinciding with that of the input gear 51.

The longitudinal dimension of the water intakes 98 is approximately equal to or greater than the vertical dimension of the water intakes 98. The axial distance between the front end 98*a* of each water intake 98 and the center axis L1 of the first drive shaft 31 is equal to the distance δ. The rear end 98*b* of each water intake 89 is on the front side of the bearings 36 and 37.

The operation and effect of the outboard motor S in the preferred embodiment will be described.

The first drive shaft 31 and the second drive shaft 32 are rotatably supported on the gear case 13, and the second shaft 32 extends downward beyond a vertical position corresponding to the lower end of the first drive shaft 31. The gear case 13 is provided with the water intakes 98 through which the water pump 90 sucks up water, and the water intakes 98 are formed in front of the second drive shaft 32 and between the first drive shaft 31 and the output gear mechanism 50 with respect to the vertical direction. Since the water intakes 98 are formed on the front side of the second drive shaft 32 disposed rearward of the first drive shaft 31 in spaces below the first drive shaft 31. Thus the water intakes 98 enable the water pump 90 to pump water at a sufficiently high rate.

The axial distance between the front end 98*a* of each water intake 98 and the center axis L1 of the first drive shaft 31 is equal to the distance δ. Thus the water intakes 98 can be formed in a large size such that the front ends 98*a* thereof are at the distance δ to the front from the center axis L1 of the first drive shaft 31.

The axial distance between the front end 98*a* of each water intake 98 and the center axis L1 of the first drive shaft 31 is equal to the distance δ. Thus the water intakes 98 can be formed in a large size such that the front ends 98*a* thereof are at the distance δ to the front from the center axis L1 of the first drive shaft 31.

At least a part of the lower end 98*d* of each water intake 98 is on the front side of the reverse gear 53 of the output gear mechanism 50, i.e., on the front side of the input gear 51 and the forward gear 52 of the output gear mechanism 50, and is at a vertical position substantially coinciding with that of the input gear 51. Thus the lower end 98*d* of each water intake 98 opening in a necessary area can be lowered in a space extending on the front side of the reverse gear 53 to the vertical position substantially coinciding with that of the input gear 51. Therefore, the water intakes 98 appear rarely above the surface of the water, suction of air through the water intake 98 can be avoided and hence the internal combustion engine E can be properly cooled.

The water pump 90 is combined with the first drive shaft 31, and the second drive shaft 32 is engaged with the output gear mechanism 50 below the first drive shaft 31. Therefore, the length of the first drive shaft 31 is shorter than in a case in which the first drive shaft 31 is directly engaged with the output gear mechanism 50. Since the first drive shaft 31 is made of an expensive corrosion-resistant material because the first drive shaft 31 is combined with the water pump 90, the shortened expensive first drive shaft 31 can be manufactured at a low cost, and the second drive shaft 32 is made of an inexpensive, ordinary ferrous material. Thus the outboard motor S can be manufactured at a low cost.

The gearing holding portion 21 has the tapered part 21*a* extending forward from the second drive shaft 32 disposed behind the first drive shaft 31 to the front end 21*c* of the gearing holding portion 21. The tapered part 21*a* has a generally tapered shape having an axis aligned with the center axis L3 of the propeller shaft 17 and tapering toward the front end 21*c*. Thus the distance from the front end 21*c* to the part corresponding to the second drive shaft 32 of the taper part 21*a* of the gear case 13 is longer than that from the front end to a part corresponding to the drive shaft of the comparative gear case by the distance by which the center axis L2 of the second drive shaft 32 is separated longitudinally rearward from the center axis L1 of the first drive shaft 31. Therefore, the radius e of the tapered part 21*a* increases more gently from the front end 21*c* toward the part corresponding to the second drive shaft 32 than that of the tapered part of the comparative gear case, and hence the cross-sectional area of the tapered part 21*a* increases gently from the front end 21*c* toward the part corresponding to the second drive shaft 32. Thus this shape of the tapered part 21*a* reduces underwater resistance. The gear case 13 does not disturb water currents excessively and cavitation on the gear case 13 and on the propeller 18 disposed behind the gear case 13 can be suppressed.

The axial distance f2 between the front end 21*c* and the center axis L4 of the shift rod 61 is not smaller than the diameter d2 of a part of the taper part 21*a* corresponding to the center axis L4, and hence the distance between the front end 21*c* and the second drive shaft 32 is enlarged. Therefore, the radius e of the tapered part 21*a* increases gently rearward from the front end 21*c*. Thus underwater resistance can be effectively reduced and cavitation can be effectively suppressed.

The second drive shaft 32 is disposed substantially in the middle part of the gearing holding portion 21. Therefore, the radius e of the tapered part 21*a* increases gradually rearward from the front end 21*c*, and increase in the frictional resistance of water to the tapered part 21*a* due to the excessively long axial distance between the front end 21*c* and the second drive shaft 32 can be suppressed.

The second drive shaft 31 is supported only in the upper bearing 38 and the lower bearing 39 disposed on the upper and the lower side, respectively, of the driven gear 35. The upper bearing 38 supporting the upper end part 32*a* extending upward from the driven gear 35 is at a vertical position substantially coinciding with that of the drive gear 34. The lower bearing 39 supports the lower end part 32*b* of the second drive shaft 32 on which the input gear 51 of the output gear mechanism 50 is mounted. Thus the second drive shaft 32 is supported by only the upper bearing 38 and the lower bearing 39, and the upper bearing 38 is at the vertical position substantially coinciding with that of the drive gear 34. Therefore, the second drive shaft 32 is shortened and made light. Since the second drive shaft 32 is supported by the upper bearing 38 above the driven gear 35, and by the lower bearing 39, the upper bearing 38 can be easily installed in place. The number of component parts is reduced and assembling work for assembling the outboard motor S is small as compared with those needed by an outboard motor having a second drive shaft supported by three or more bearings.

The intermediate gear mechanism 33 is a reduction gear mechanism. The upper bearing 38 is at a vertical position substantially coinciding with that of the toothed part 35*b* of the driven gear 35; that is, the upper bearing 38 is disposed in a cylindrical space 43 surrounded by the toothed part 35*b* of the driven gear 35. Since the upper bearing 38 is disposed in the cylindrical space 43 defined by the driven gear 35, the length of an upper end part of the second drive shaft 31 projecting upward from the driven gear 35 can be shortened and hence the overall length of the second drive shaft 32 is shortened. The driven gear 35 having a diameter greater than that of the drive gear 34 defines the cylindrical space 43. Therefore, the large driven gear 35 has a small weight.

The upper bearing 38 is a double-row taper roller bearing. Since the upper bearing 38 is capable of sustaining both upward and downward axial load, the second drive shaft 32 can be surely supported.

The oil pump 70 disposed in the gear case 13 is driven by the first drive shaft 31 and is separated from the intermediate gear mechanism 33. Therefore, the freedom of determining the capacity of the oil pump is high as compared with a case in which the intermediate gear mechanism 33 serves also as an oil pump. Thus an oil pump having a desired discharge capacity can be easily selected.

Since the oil pump 70 is driven by the first drive shaft 31 that rotates at a rotational speed higher than that of the second drive shaft 32, the oil pump 70 having a desired discharge capacity is small, and hence the gear case 13 may be small.

The oil pump 70 disposed at the vertical position lower than that of the intermediate gear mechanism 33 and sucks up the oil contained in the gear case and having its surface at the oil level OL below the intermediate gear mechanism 33. Therefore, the resistance of the oil to stirring is low and the loss of power of the first drive shaft 31 and the second drive shaft 32 is small.

The first drive shaft 31 is provided with the discharge passage 81 for delivering the oil discharged from the oil pump 70 to the parts requiring lubrication including the bearings 36, 37, 38 and 39 and the intermediate gear mechanism 33. Since the discharge passage 81 for delivering the oil to the parts requiring lubrication is formed in the first drive shaft 31, the gear case 13 does not need to be provided with any discharge passage and hence the gear case 13 can be formed in a small size.

The interlocking mechanism 63 of the operating mechanism for operating the clutch 54 includes the pinion 63*a* mounted on the shift rod 61, and the rack 63*b* formed integrally with the operating rod 52, extending parallel to the propeller shaft 17 and meshed with the pinion 63*a*. Thus, the interlocking mechanism 63 does not move transversely like an interlocking mechanism including an eccentric pin and a cam mechanism. The operating rod 62 can be moved in a wide range according to the turning angle of the shift rod 61. Therefore, the outside diameter of a part of the gear case 13 around the interlocking mechanism 13 may be small and hence the underwater resistance to the gear case 13 is low.

The gear case 13 has the gearing holding portion 21 holding the output gear mechanism 50, the propeller shaft 17 and the interlocking mechanism 63. The axial distance between the center axis L2 of the lower end part 32*b* of the second drive shaft 32 engaged with the output gear mechanism 50 and the center axis L4 of the shift rod 61 is greater than the outside diameter d1 of the part of the gearing holding portion 21 corresponding to the center axis L2. Therefore, the front part of the gearing holding portion 21 extending forward from the center axis L2 can be formed in an elongated narrow shape, so that the outside diameter of the gearing holding portion 21 can be made to increase gently rearward from the front end 21*c*, which is effective in reducing the underwater resistance.

The first drive shaft 31 is connected to the internal combustion engine E, and the second drive shaft 32 is interlocked with the first drive shaft 31 by the intermediate gear mechanism 33 to transmit the power of the first drive shaft 31 to the output gear mechanism 50. The rotational speed of the first drive shaft 31 is reduced to the rotational speed of the second drive shaft 32 by the intermediate gear mechanism 33, and the output gear mechanism 50 is driven by the second drive shaft 32 rotating at the reduced rotational speed. Therefore, the reduction ratio of the output gear mechanism 50 may be low and hence the gearing holding portion 21 of the gear case 13 can be formed in a small size.

Modifications of the foregoing embodiment will be described.

The output gear mechanism 50 of the foregoing embodiment is of a standard rotation type. An output gear mechanism 150 of a counter rotation type will be described with reference to FIGS. 7A and 7B. When two outboard motors are mounted on the hull, the respective propellers of the two outboard motors rotate in opposite directions, respectively. One of the two outboard motors is provided with an output gear mechanism of a standard rotation type and the other outboard motor is provided with an output gear mechanism of a counter rotation type.

The outboard motor in the modification is basically the same in construction excluding the output gear mechanism 150. In FIG. 7, parts like or corresponding to those shown in FIGS. 1 to 6 are designated by the same reference characters when necessary.

In the output gear mechanism 150, a forward gear 152 is supported in two bearings 46 and 47 on a front part 17*a* of a propeller shaft 17 at a position on the front side, with respect to a longitudinal direction, of the center axis L2 of an input gear 51 in a gearing holding portion 21. A reverse gear 153 is supported in bearings 48 and 49 on the front part 17*a* at a position on the rear side, with respect to the longitudinal direction, of the center axis L2 of the input gear 51.

Figures 7A, 7B:
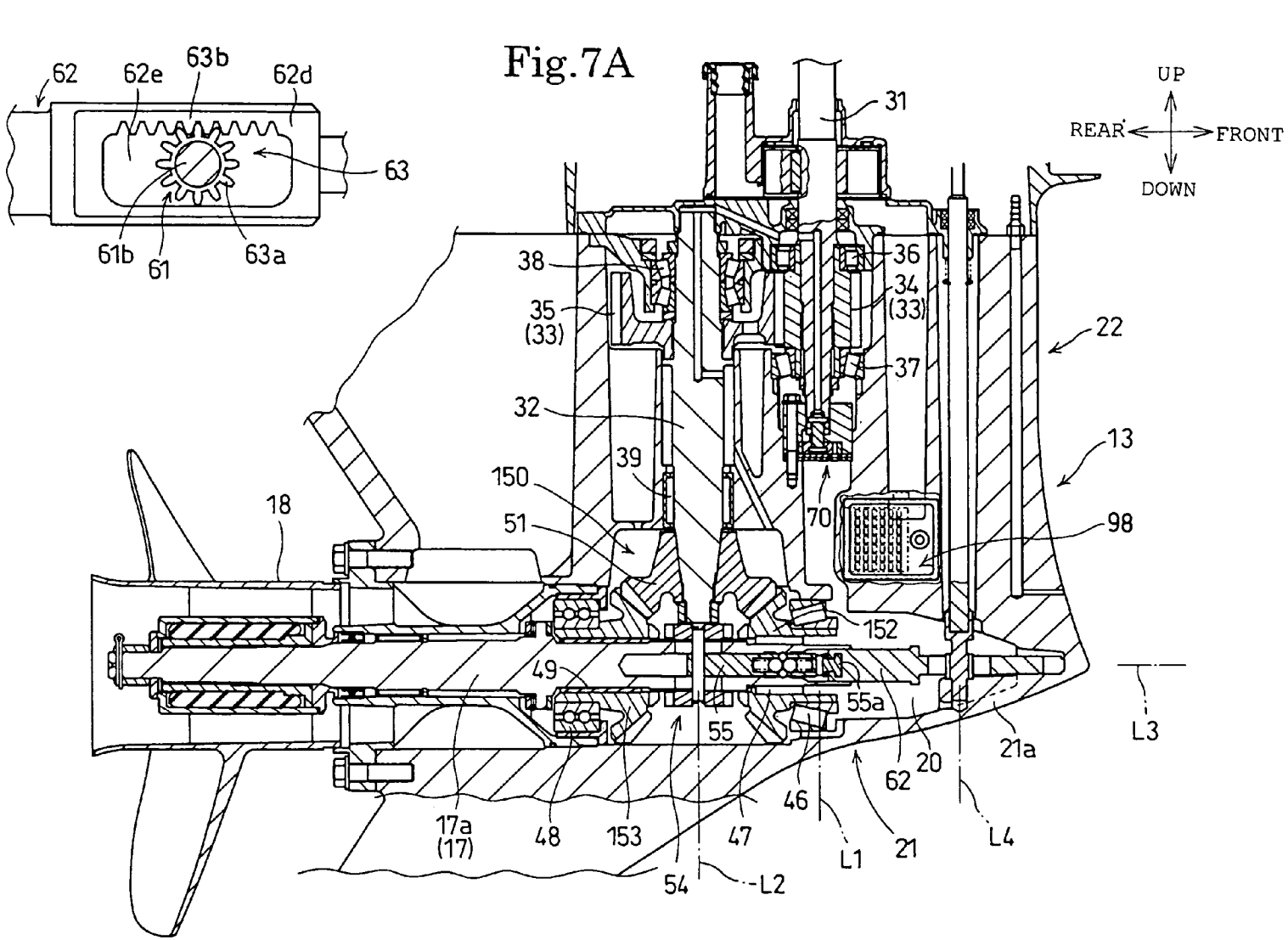
FIG. 7A is a view, corresponding to FIG. 2, of a modification of the outboard motor embodying the present invention.
FIG. 7B is a view of a part of the modification shown in FIG. 7A corresponding to an essential part shown in FIG. 5A.

As shown in FIG. 7B, a recessed part 62*c* (FIG. 5B) of an operating rod 62 is connected to a connecting part 55*a* in a transversely inverted position with respect to the output gear mechanism 150 of the standard rotation type. Thus a rack 63*b* is disposed at a transversely inverted position relative to the pinion 63*a*.

When a shift rod 61 is turned to turn the pinion 63*a* clockwise as viewed in FIG. 7B, the rack 63*b* and the operating rod 62 are moved forward, a shifter 55 is moved forward to set the clutch mechanism 54 in a forward position. When the shift rod 61 is turned to turn the pinion 63*a* counterclockwise as viewed in FIG. 7B, the rack 63*b* and the operating rod 62 are moved rearward, the shifter 55 is moved rearward to set the clutch mechanism 54 in a reverse position.

When the method of connecting the operating rod 62 to the shifter 55 is thus changed, the moving direction of the ship provided with the outboard engine of a counter rotation type can be controlled in the mode of operating the shift rod 61 of the outboard motor of a standard rotation type.

A device corresponding to the screw pump 71 shown in FIG. 2 may be omitted, as shown in FIG. 7A, from a lubricating system for lubricating the bearings 36, 37, 38 and 39 and the intermediate gear mechanism 33 held in the gear case 13.

An oil pump 70, namely, a trochoid pump, may be omitted from the lubricating system, a screw pump 71 may be combined with a first drive shaft 31 or a second drive shaft 32, and the bearings 36, 37, 38 and 39 and the intermediate gear mechanism 33 may be lubricated with oil pumped by the screw pump 71.

The internal combustion engine may be a single-cylinder internal combustion engine, an in-line multicylinder internal combustion engine other than the in-line four-cylinder internal combustion engine, or a V-type internal combustion engine, such as a V-6 internal combustion engine. The marine propulsion machine may be an inboard motor.

What is claimed is:

1. A marine propulsion machine comprising:

a drive shaft means rotatably driven by an engine and including a first drive shaft having a vertical center axis and interlocked with the engine, and a second drive shaft having a vertical center axis, interlocked with the first drive shaft and disposed on a rear side of the first drive shaft;

a gear case normally lying beneath the surface of the water said gear case having a gear holding part and a support part extending upward from the gear holding part;

an output gear mechanism driven by the second drive shaft and held in the gear holding part of the gear case;

a propeller shaft held in the gear holding part of the gear case and driven for rotation by power transmitted thereto through the output gear mechanism; and a water pump driven by the drive shaft means, wherein the first drive shaft and the second drive shaft are rotatably supported on the gear case, the first drive shaft has a lower end located substantially in a middle of said support part, with respect to a vertical direction; the second drive shaft extends downward beyond a vertical position corresponding to a lower end of the first drive shaft, and wherein the support part of the gear case is formed in opposite side surfaces thereof with a pair of water intake openings through which the water pump sucks water, and at least a part of each of the water intake openings is located below a plane orthogonal to the first drive shaft and at the lower end of the first drive shaft and above a plane orthogonal to the second drive shaft and corresponding to a top of the output gear mechanism and is on a front side of the second drive shaft.

2. The marine propulsion machine according to claim 1, wherein the water intakes has a front end located at a distance equal to a distance between the center axis of the first drive shaft and the center axis of the second drive shaft forward from the center axis of the first drive shaft with respect to a longitudinal direction.

3. The marine propulsion machine according to claim 1, further comprising a shift rod disposed on the front side of the first drive shaft to change propelling directions, the water intakes being disposed in a space between the vertical center axis of the first drive shaft and the shift rod with respect to a longitudinal direction.

4. A marine propulsion machine comprising:

a drive shaft means driven by an engine and including a first drive shaft having a vertical center axis and interlocked with the engine, and a second drive shaft having a vertical center axis, interlocked with the first drive shaft and disposed on a rear side of the first drive shaft;

a gear case normally lying beneath the surface of the water, said gear case having a gear holding part and a support part extending upward from the gear holding part;

an output gear mechanism held in the gear holding part of the gear case and having an input gear interlocked with the second drive shaft;

a propeller shaft held in the gear holding part of the gear case and driven for rotation by power transmitted thereto through the output gear mechanism; and a water pump driven by the drive shaft means, wherein the first drive shaft has a lower end located substantially in a middle of said support part, with respect to a vertical direction; the second drive shaft extends downward beyond a vertical position corresponding to the lower end of the first drive shaft, and the support part of the gear case is provided with at least one water intake through which the water pump sucks water, and at least a part of a lower end of the water intake is on a front side of the output gear mechanism and wherein at least a part of the lower end of the water intake and the input gear of the output gear mechanism both intersect a plane orthogonal to the second drive shaft.

5. The marine propulsion machine according to claim 4, wherein each of the water intakes is formed in the gear case such that at least a part thereof is below the plane orthogonal to the first drive shaft and above a plane orthogonal to the second drive shaft and corresponding to the top of the output gear mechanism and is on a front side of the second drive shaft.

6. A marine propulsion machine comprising:

a drive shaft means driven by an engine and including a first drive shaft having a vertical center axis and interlocked with the engine, and a second drive shaft having a vertical center axis, interlocked with the first drive shaft and disposed on the rear side of the first drive shaft;

a gear case normally lying beneath the surface of the water, said gear case having a gear holding part and a support part extending upward from the gear holding part;

an output gear mechanism driven by the second drive shaft of the drive shaft means and held in the gear holding part of the gear case;

a propeller shaft driven for rotation by power transmitted thereto through the output gear mechanism; and a water pump driven by the drive shaft means;

wherein the first drive shaft has a lower end located substantially in a middle of said support part, with respect to a vertical direction; the second drive shaft extends downward beyond a vertical position corresponding to the lower end of the first drive shaft, and the water pump is combined with the first drive shaft, and wherein the support part of the gear case is formed in opposite side surfaces with a pair of water intake openings through which the water pump sucks water, and at least a part of each of the water intake openings is located below a plane corresponding with and orthogonal to the lower end of the first drive shaft and above a plane orthogonal to the second drive shaft and corresponding to a top of the output gear mechanism and is on a front side of the second drive shaft.

7. The marine propulsion machine according to claim 6, wherein the water intake openings are formed in the gear case on a front side of the second drive shaft.

* * * * *